US010683986B2

(12) United States Patent
Lefaudeux et al.

(10) Patent No.: US 10,683,986 B2
(45) Date of Patent: Jun. 16, 2020

(54) LUMINOUS MODULE COMPRISING A MONOLITHIC ELECTROLUMINESCENT SOURCE

(71) Applicant: VALEO VISION, Bobigny (FR)

(72) Inventors: Nicolas Lefaudeux, Bobigny (FR); Antoine De Lamberterie, Bobigny (FR); Guillaume Thin, Bobigny (FR); Samira Mbata, Bobigny (FR); Thomas Canonne, Bobigny (FR); Van Thai Hoang, Bobigny (FR); Vincent Dubois, Bobigny (FR); Francois-Xavier Amiel, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 16/333,910

(22) PCT Filed: Jul. 26, 2017

(86) PCT No.: PCT/EP2017/068934
§ 371 (c)(1),
(2) Date: Mar. 15, 2019

(87) PCT Pub. No.: WO2018/050337
PCT Pub. Date: Mar. 22, 2018

(65) Prior Publication Data

US 2019/0203907 A1 Jul. 4, 2019

(30) Foreign Application Priority Data

Sep. 15, 2016 (FR) ..... 16 58664

(51) Int. Cl.
*F21V 5/00* (2018.01)
*F21S 41/143* (2018.01)
(Continued)

(52) U.S. Cl.
CPC ..... *F21V 5/004* (2013.01); *F21K 9/60* (2016.08); *F21S 41/143* (2018.01);
(Continued)

(58) Field of Classification Search
CPC ..... F21V 5/004; F21S 41/143; F21S 41/285; F21S 43/14; F21S 43/26; F21S 41/153
See application file for complete search history.

(56) References Cited

U.S. PATENT DOCUMENTS

2008/0013329 A1 1/2008 Takeda et al.
2010/0117997 A1 5/2010 Haase
(Continued)

FOREIGN PATENT DOCUMENTS

WO WO 2008/109296 A1 9/2008
WO WO 2011/135508 A2 11/2011

OTHER PUBLICATIONS

International Search Report dated Oct. 5, 2017, in PCT/EP2017/068934 filed on Jul. 26, 2017.

*Primary Examiner* — Joseph L Williams
(74) *Attorney, Agent, or Firm* — Oblon, McClelland, Maier & Neustadt, L.L.P.

(57) ABSTRACT

A luminous module, in particular for a motor vehicle, including: a monolithic electroluminescent source including electroluminescent elements; a primary optical system equipped with a plurality of convergent optics, at least one convergent optic being associated with each electroluminescent element and forming an image of the electroluminescent element with which it is associated.

19 Claims, 3 Drawing Sheets

(51) Int. Cl.

| | |
|---|---|
| ***F21S 41/20*** | (2018.01) |
| ***F21S 41/153*** | (2018.01) |
| ***F21S 43/14*** | (2018.01) |
| ***F21S 43/20*** | (2018.01) |
| ***F21K 9/60*** | (2016.01) |
| ***F21S 41/255*** | (2018.01) |
| *F21Y 105/16* | (2016.01) |
| *F21Y 115/10* | (2016.01) |
| *F21W 107/10* | (2018.01) |

(52) U.S. Cl.

CPC ..... *F21S 41/153* (2018.01); *F21S 41/255* (2018.01); *F21S 41/285* (2018.01); *F21S 43/14* (2018.01); *F21S 43/26* (2018.01); *F21V 5/007* (2013.01); *F21W 2107/10* (2018.01); *F21Y 2105/16* (2016.08); *F21Y 2115/10* (2016.08)

(56) References Cited

U.S. PATENT DOCUMENTS

| | | | |
|---|---|---|---|
| 2011/0260178 | A1 | 10/2011 | Bierhuizen |
| 2015/0069433 | A1 | 3/2015 | Haase |

LUMINOUS MODULE COMPRISING A MONOLITHIC ELECTROLUMINESCENT SOURCE

FIELD OF THE INVENTION

The invention relates to the field of luminous land-vehicle modules, i.e. modules that are able to be integrated into a luminous vehicle device and allowing, during use of the vehicle, light to be projected so as to illuminate the road or the passenger compartment and/or allowing the vehicle to be made more visible. Examples of such luminous devices are side lights or the low-beam and/or high-beam lights (commonly referred to as "headlights").

BACKGROUND

Land vehicles are equipped with luminous devices, in particular lighting and/or signalling devices, such as headlamps or rear lights, that are intended to illuminate the road in front of the vehicle at night or in case of low visibility. They may also serve to illuminate the passenger compartment of the vehicle. These luminous devices may comprise one or more luminous modules. Each lighting function may be performed by one or more modules.

In these luminous land-vehicle modules, electroluminescent light sources are more and more frequently used. These light sources may consist of light-emitting diodes or LEDs, of organic light-emitting diodes or OLEDs, or even of polymer light-emitting diodes or PLEDs.

Solid-state monolithic light sources (also known as monolithic arrays of LEDs) have been known about for a short while. Monolithic light sources comprise tens, hundreds, or even thousands of LEDs that are located on the same substrate, the LEDs being separated from the others by lanes or streets. In this monolithic-array context the LEDs are also called pixels. These light sources are said to be of high LED density because the number of pixels is great, for example several hundred LEDs per $cm^2$. Each of the LEDs is electrically independent from the others and therefore illuminates autonomously from the other LEDs of the array. Thus, each LED of the array is individually controlled by the electronic circuit (called the driver) that manages its electrical power supply.

Solid-state monolithic light sources have many advantages. They firstly deliver a high light intensity, this making it possible to improve the illumination of the scene and thus for example to make driving a motor vehicle safer. In addition, they create a highly pixelized light beam that allows existing driver-assist functionalities and in particular adaptive lighting functions to be implemented and improved. For example, an anti-glare function may be configured so that only the windshield of an oncoming vehicle is no longer illuminated.

Solid-state monolithic light sources however have drawbacks. Firstly, these light sources heat and require a specific management of the heat generated by the electroluminescent elements. Specifically, the generated heat leads to an increase in the temperature of components, which may degrade these components and/or prevent optimal use thereof. In addition, these light sources suffer from crosstalk, i.e. the light emitted by an electroluminescent element interferes at least with the light emitted by the neighbouring electroluminescent elements. The pixelization of the light beam emitted by the source is therefore affected. Furthermore, some of the light emitted is lost because all the emitted light cannot be collected because of the angle of emission of the electroluminescent elements, which is large. Lastly, another problem is that the lanes or streets present on the source cause intervals to appear between the various light beams from which the beam of the source is composed. The light beam obtained as output is therefore not a uniform light beam. In addition, these lanes or streets form non-emissive zones that cause the average luminance of the source to drop below the value of the luminance of the emitter. This loss may be very great; for example, if the pitch is 50 μm and the emitters are of 40 μm, the non-emissive area is about 36% of the total area of the source.

SUMMARY OF THE INVENTION

Thus, a luminous module, in particular for a motor vehicle, is provided, which comprises: a monolithic electroluminescent source comprising electroluminescent elements; a primary optical system equipped with a plurality of convergent optics, at least one convergent optic being associated with each electroluminescent element and forming an image of the electroluminescent element with which it is associated.

According to various examples, the luminous module may comprise one or more of the following features combined together:

- the electroluminescent elements of the monolithic source form an array of electroluminescent elements, and the convergent optics form an array of convergent microlenses;
- the optical axis of said at least one convergent optic is aligned with the centre of the electroluminescent element with which said at least one convergent optic is associated;
- the distance between said at least one convergent optic and the electroluminescent element with which said at least one convergent optic is associated is smaller than or equal to the object focal length of said at least one convergent optic;
- the angle of collection of the convergent optics is comprised between 30° and 70°, inclusive of limits;
- the plurality of convergent optics of the primary optical system covers the monolithic electroluminescent source;
- the plurality of convergent optics makes contact with the monolithic electroluminescent source;
- an intermediate element is arranged between the plurality of convergent optics and the monolithic electroluminescent source;
- the distance between the centre of a first pixel and the centre of a second pixel neighbouring the first is comprised between 20 and 500 microns (μm);
- the dimensions of an electroluminescent element are comprised between 10 and 500 microns (μm);
- the primary optical system is arranged so that the images that it forms are substantially adjacent in order to form a continuous uniform distribution of light;
- each convergent optic comprises at least one convex segment;
- the plurality of convergent optics is integrally formed from the same material;
- the electroluminescent elements of the monolithic electroluminescent source are light-emitting diodes.

A luminous device, in particular a luminous lighting and/or signalling device for a land vehicle, is also provided, which comprises: the above luminous module; an optical projecting system forming an image of the images produced by the primary optical system.

BRIEF DESCRIPTION OF THE FIGURES

Various embodiments of the invention will now be described, by way of completely nonlimiting example, with reference to the appended drawings, in which:

FIG. 4 schematically shows an example of a micro-lens seen face-on;

DETAILED DESCRIPTION

The luminous module according to the invention comprises a solid-state electroluminescent light source (solid-state lighting). The electroluminescent source comprises electroluminescent elements that are of submillimetre-sized dimensions. The source furthermore comprises a substrate on which the electroluminescent elements are grown epitaxially. The electroluminescent elements use electroluminescence to emit light. Electroluminescence is an optical and electrical effect during which a material emits light in response to an electrical current flowing therethrough, or to a strong electric field. It is to be distinguished from light emission due to temperature (incandescence) or to the action of chemical products (chemiluminescence).

The electroluminescent source is a monolithic electroluminescent source, i.e. the electroluminescent elements are located and grown epitaxially on the same substrate, and preferably on the same face of the substrate which may for example be made of sapphire. The electroluminescent elements are deposited on or extend from at least one face of the substrate. The electroluminescent elements of the monolithic array are separated from one another by lanes or streets. The terms lanes and streets are synonymous. These lanes or streets are spaces separating the electroluminescent elements. These spaces may be empty, or indeed contain elements introduced for example for the management of crosstalk effects. The monolithic electroluminescent source forms a grid of electroluminescent elements or even an array of electroluminescent elements.

An electroluminescent element may be, but is not limited to, a light-emitting diode (LED), an organic light-emitting diode (OLED), or a polymer light-emitting diode (PLED). The electroluminescent source is therefore a semiconductor light source and it includes a substrate on which the electroluminescent elements are placed. An electroluminescent element is more generally called a pixel. Therefore, the light source comprises a plurality of pixels deposited on or extending from the first face of the substrate. The pixels (i.e. the electroluminescent elements) emit light when the semiconductor is supplied with electricity. It is therefore possible to say that a pixel is turned on when an electroluminescent element emits light.

The monolithic electroluminescent source may be a monolithic electroluminescent source of high luminous-element density, i.e. it comprises a very high number of electroluminescent elements. By very high number, what must be understood is that the substrate of the light source comprises at least 400 electroluminescent elements on the same substrate. For example, if the pitch is 200 μm, the density of pixels is then 2500 electroluminescent elements per square centimetre ($cm^2$). The dimensions of the pixels may vary, depending on the sought-after density of pixels per $cm^2$.

Figure 1:
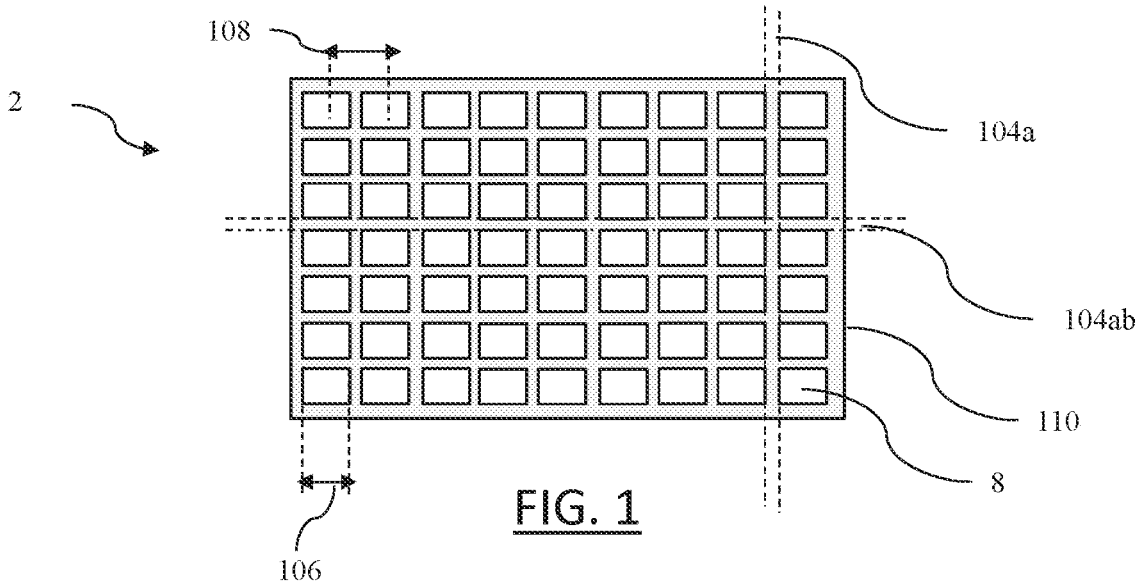
FIGS. 1 and 2 schematically show an example of an electroluminescent monolithic source of high pixel density.
Figure 2:
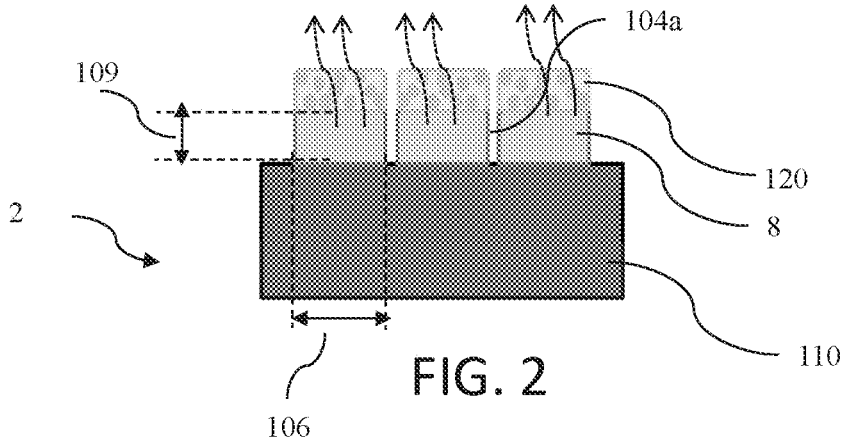

FIG. 1 shows a view from above of an example of a monolithic electroluminescent source 1 of high electroluminescent-element density. FIG. 2 shows one portion of the view from the side of the example of FIG. 1. The electroluminescent elements 8 have been deposited on a substrate 110, for example one made of sapphire. The electroluminescent elements 8 are in these examples LEDs. The LEDs have been placed so that they form a grid of LEDs that is also called an array of LEDs. The LEDs are separated by rectilinear lanes or streets that are arranged vertically 104*a* and horizontally 104*b*. The regular pattern thus formed integrates perfectly into current light-source manufacturing processes.

Furthermore, in the examples of FIGS. 1 and 2, the LEDs have a (substantially) square shape and have a dimension of 40 μm. This dimension relates to one of the sides of the square 106. The dimension is therefore the width of the LED. The lanes or streets 104*a*, 104*b* all have a width of 10 μm. The pitch 108 between the LEDs is therefore 50 μm. The pitch is the distance between the centre of a first pixel and the centre of a second pixel neighbouring the first; this distance is also called pixel pitch. The pitch therefore depends on the dimension of the pixels and on the width of the lanes or streets. The electroluminescent elements 8 also have a height 109 that depends on the technology used to manufacture them. The height of an electroluminescent element is measured from the surface of the substrate on which the electroluminescent element is deposited or from which it extends. For example, the LEDs may have a height of 100 μm.

In practice, all the LEDs and all the lanes or streets of a monolithic electroluminescent source have dimensions that are equal or substantially equal. The source forms a regular grid pattern of electroluminescent elements.

It will be understood that the LEDs may have other shapes, depending on the technology used to manufacture them. In this case, the definition of the term dimension may vary. For example, if the LEDs have a rectangular shape, it is possible by convention to decide that the dimension of an LED will be the distance of the shortest side of the rectangle. By way of another example, if the LEDs have a circular shape, it is possible by convention to decide that the dimension of an LED will be its diameter.

The electroluminescent elements are each semiconductor elements, i.e. they each include at least one semiconductor. The electroluminescent elements may be mainly made of semiconductor. This semiconductor may be the same as or different from the semiconductor of the substrate. The electroluminescent elements may more generally all be made from the same material or materials. The electroluminescent elements may be of the same nature, and for example substantially identical or similar. All the electroluminescent elements may be positioned to form a regular pattern, for example a grid.

Each of the electroluminescent elements of the monolithic electroluminescent source is electrically independent from the others and emits or does not emit light independently from the other elements of the array. Each element of the array is controlled individually by an electronic circuit called a driver. The driver manages the supply of electrical power to the monolithic array, this amounting to saying that it individually manages the supply of electrical power to each electroluminescent element. Alternatively, electroluminescent elements may be grouped together electrically, for example by supplying them with electrical power via a parallel or series set-up, in order to decrease the number of elements to be managed. For example, the groups may comprise between two and four electroluminescent elements, this number allowing a sufficiently pixelized light beam to be preserved. The driver is therefore an electronic device that is able to control the elements of a monolithic array of electroluminescent elements. A plurality of drivers may be used to control the electroluminescent elements of the source.

The luminous module may comprise one or more monolithic electroluminescent sources. A plurality of luminous modules comprising such a monolithic electroluminescent source may be integrated into the luminous device according to the invention. The term "luminous module" therefore designates at least one monolithic electroluminescent source.

The luminous module in addition comprises a layer covering the semiconductor. This layer modifies the spectrum of the light emitted by the semiconductor. The spectrum is defined by a continuum of wavelengths, and the layer therefore modifies the wavelengths of the electromagnetic radiation forming the spectrum of the emitted light. "Cover" means that the layer is arranged with respect to the semiconductor so that the light that it emits passes through the layer. The latter may make contact with at least that surface of the semiconductor through which the light produced by the semiconductor escapes. Alternatively, a third material may serve as interface between the layer and that surface of the semiconductor through which the light produced by the semiconductor escapes; this third material may be silicone, which is a polymer. FIG. 2 shows an example in which each electroluminescent element is individually covered by the layer 120. More precisely, the layer makes contact with that surface of the electroluminescent element through which the photons emitted by the semiconductor escape. The path of the light is shown by the dashed arrows. The layer 120 is a converter of light or luminophore, and it comprises at least one luminophore designed to absorb at least some of at least one exciting wavelength emitted by a light source and to convert at least some of said absorbed excitation light into a light emission having a light spectrum different from that of the excitation light.

The luminous module according to the invention therefore comprises a monolithic electroluminescent source that may be of high electroluminescent-element density. The luminous module in addition comprises a primary optical system that is equipped with a plurality of convergent optics. Each convergent optic of the primary optical system forms an image of an electroluminescent source. One or more convergent optics are associated with each electroluminescent element. The association is exclusive, i.e. the one or more optics are tasked with making the light of one and only one electroluminescent element converge. Preferably, one optic is associated with one electroluminescent element. The conversion optic forms an image of the electroluminescent element with which it is associated. The formed image is preferably a virtual image. The creation of a real image may also be envisioned.

The electroluminescent elements of the monolithic source preferably form an array of electroluminescent elements. As explained with reference to FIG. 1, the electroluminescent elements are placed on the substrate of the source in a regular pattern, for example that of a grid. The convergent optics also preferably form an array of convergent lenses. The convergent lenses of the array of convergent lenses are placed so that there is a correspondence between an electroluminescent element and the lens that is associated therewith, for example the lens covers the electroluminescent element. This does not exclude the array of convergent lenses not necessarily being strictly of the same pitch as the monolithic source; for example, a slightly different pitch may allow the rays emitted by the electroluminescent elements to be re-oriented on the edge of the monolithic electroluminescent source.

This correspondence may be ensured by aligning the optical axis of the convergent optic on the centre of the electroluminescent element with which said at least one convergent optic is associated.

Patterns other than a regular grid may be envisioned for the arrays of electroluminescent elements and of convergent optics; for example, the elements of a lane may be offset with respect to another neighbouring lane. Any pattern, whether it be regular or not, may be envisioned.

The electroluminescent elements are preferably of submillimetre-sized dimensions in order for the monolithic source to be of high luminous-pixel density. In this context, the convergent optics are convergent micro-lenses of millimetre-sized or submillimetre-sized dimensions.

Figure 4:
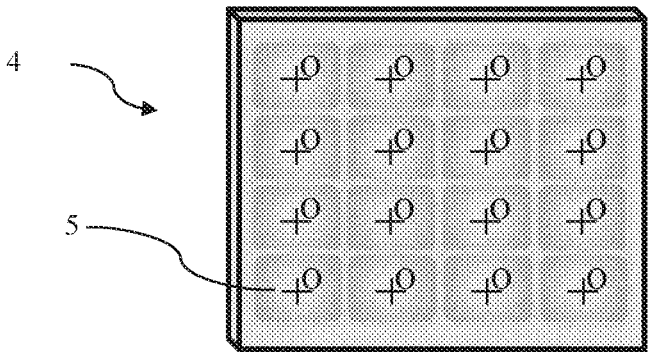

FIG. 4 shows an example of a grid of convergent micro-lenses of optical centre "O" through which the optical axis passes.

Figure 5:
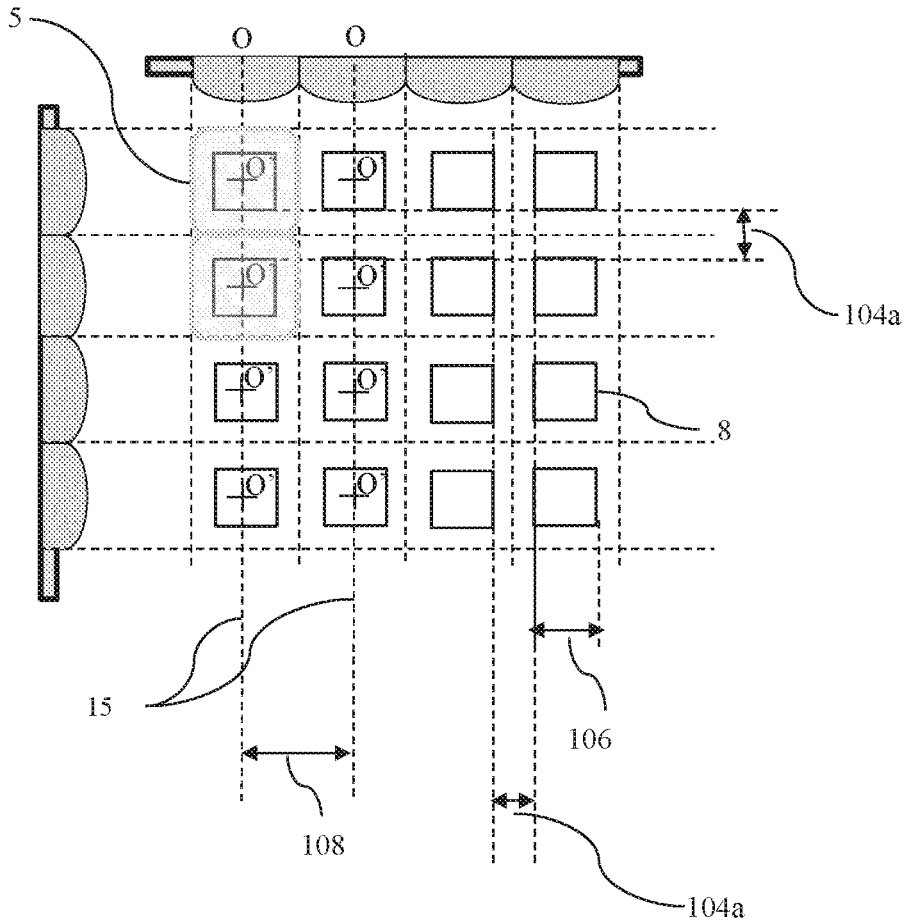
FIG. 5 schematically shows an example of the fitting of a light source with a micro-lens.

FIG. 5 schematically shows an example of a set of convergent micro-lenses, for example the grid of micro-lenses shown in FIG. 4, the optical axes of which (shown by dashed lines 15 passing through their optical centre "O") are aligned with the centre "O" of the electroluminescent elements 8.

In the context of the present invention, the term "micro-lens" is understood to mean dioptric interfaces that make light converge and the outside dimensions of which are smaller than or equal to five times the dimensions of the electroluminescent elements of the light source. In practice, the micro-lenses have a dimension that is comprised between one and five times, inclusive of limits, those of the electroluminescent elements. Thus, if one electroluminescent element has for dimension a length L and a width l, said dimension being denoted (L×l), then the micro-lens will have a dimension (L'×l') with $L \leq L' \leq 5 \times L$ and $l \leq l' \leq 5 \times l$. This dimensioning allows a good luminance to be preserved. For example, for an individual light-emitting diode (LED) the emitting area of which is of 50 μm side length, the dimensions of the associated dioptric interface will be inscribed in a square of 250 μm side length maximum. The micro-lenses are in general in a submillimetre-sized order of magnitude.

In addition, if all the electroluminescent elements are of the same dimension, provision will possibly be made for all the micro-lenses to have the same dimension. Advantageously however, provision will also possibly be made for the micro-lenses associated with the sources on the border of the array, in particular at the lateral ends thereof, to be of larger dimensions than the others in order to form a laterally and vertically elongated image that will give a projected luminous pattern of larger size than the others, in particular in order to produce an illumination of the roadsides.

The convergent optic may preferably be placed, with respect to the electroluminescent element with which it is associated, at a distance that is smaller than or equal to the object focal length of the convergent optic in order to ensure the creation of a virtual image of the electroluminescent element. The virtual image thus created may serve as a new light source, for example for a projecting lens. The virtual image obtained is enlarged with respect to the electroluminescent element. The primary optical system, for example an array of micro-lenses, therefore allows virtual images of the electroluminescent elements of the monolithic electroluminescent source to be formed.

Alternatively, the convergent optic may be placed, with respect to the electroluminescent element with which it is associated, at a distance that is larger than the object focal length of the convergent optic in order to ensure the creation of a real image of the electroluminescent element. In this case, and compared to the preceding case in which a virtual image is created, the micro-lens must have a much shorter focal length and must therefore be more curved, this complexifying its production.

The convergent optic may furthermore be placed at a distance from the electroluminescent element that is chosen so that the convergent optic collects the largest possible amount of light emitted by the electroluminescent element. The electroluminescent element emits light into a half-space—in practice an emission cone 180°—, and it is therefore very difficult to collect all the light that it emits. In practice, the chosen distance is the shortest possible in order that the convergent optic be as close as possible to the electroluminescent element in order to capture a maximum of the light emitted by the electroluminescent element: the loss of the emitted light is thus minimized. Almost all the entirety of the emitted light may be collected, this allowing a used maximum light energy to be obtained.

In one preferred example, the convergent optics make contact with the electroluminescent elements, i.e. there is no intermediate element, such as for example air, between the electroluminescent elements and the convergent optics. There is no loss of light due to passage of the light through air or any other material. Alternatively, an intermediate element forms the junction between the convergent optics and the electroluminescent elements. The material serving as intermediary element is selected so that losses are avoided.

Furthermore, in order to ensure that a maximum of the light emitted by an electroluminescent element is used, the plurality of convergent optics of the primary optical system may cover the monolithic electroluminescent source. In other words, the electroluminescent elements and the streets/lanes separating them are covered by the primary optical system. Thus, for a given pitch between two electroluminescent elements—i.e. for a given distance between the centre of a first electroluminescent element and the centre of a second electroluminescent element neighbouring the first—, the dimensions of the two associated convergent optics—i.e. that of said at least one convergent optic with which the first electroluminescent element is associated and that of said at least one convergent optic with which the second electroluminescent element is associated—will be chosen so that the two lenses cover the two electroluminescent elements over all the length of the given pitch.

Alternatively, the convergent lenses may be separate, and therefore not form a single element. This may for example be the case with electroluminescent elements that are individually covered with a lens.

In FIG. 5, the pitch 108 between the LEDs comprises the edge-to-edge distance of one LED 8 and the width of one street 104*a*, 104*b*—all the LEDs and streets of the source have an equal size—, and each micro-lens has dimensions (L'×l') that are equal to the pitch so that each micro-lens covers the LED in its entirety and all or some of the streets.

Covering the electroluminescent elements with the convergent optics of the primary optical system makes it possible to ensure that all of the light emitted by the electroluminescent elements is used in the generated light beam, for example on exiting the primary optical system. In practice, an increase of 70% is measured in the light intensity of the light beam generated by the luminous module according to the invention, in comparison with a prior-art luminous module: specifically, the luminous module according to the invention collects all the light emitted by the electroluminescent elements. By virtue of this observed increase, the luminous module according to the invention permits a decrease in the size of the emitting areas of the electroluminescent elements while achieving a light intensity at least equal to that obtained with known prior-art luminous modules.

The decrease in the size of the emitting areas may be achieved by increasing the width of the streets/lanes separating the electroluminescent elements. Alternatively, the dimensions of the electroluminescent elements may be decreased. In any case, a decrease in the (light-) emitting areas of the electroluminescent source associated with the primary optical system leads to an increase in luminance and to an increase in light flux. By virtue of this decrease in the size of the emitting areas, the light source consumes less power, this allowing the amount of heat to be removed from the luminous module to be decreased. Thus, the semiconductor junctions of the electroluminescent elements work at lower temperatures, this increasing efficiency and the lifetime of the electroluminescent elements. It is furthermore possible to supply them with a higher current density in order to increase luminance. In addition, the manufacture of the light source is facilitated, this possibly having an economical advantage.

A larger spacing of the electroluminescent elements furthermore allows crosstalk effects to be decreased, the larger spacing between the elements being compensated for by the primary optical system, which collects all the light, even that emitted with a large emission angle.

Figure 6:
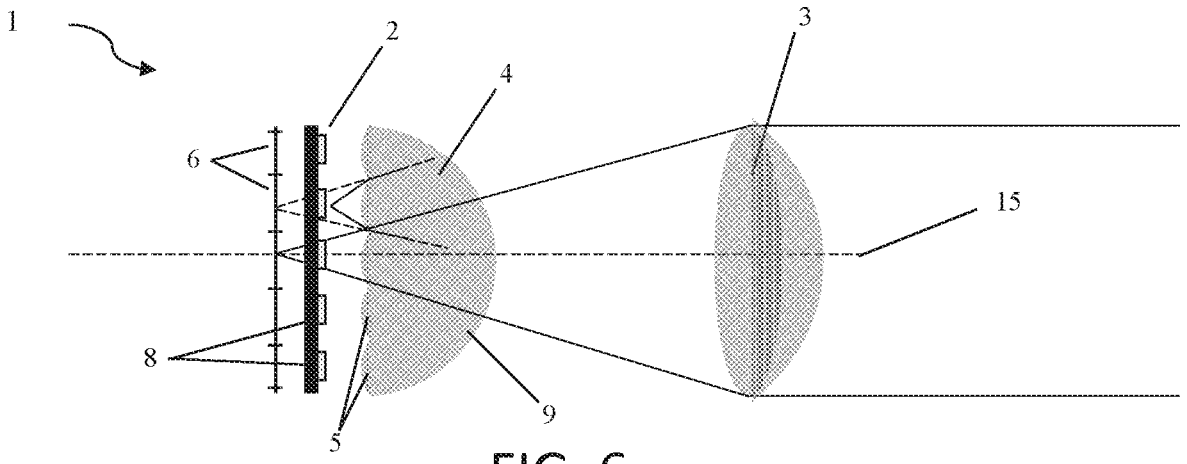
FIG. 6 schematically illustrates a perspective view of an example of a projecting module according to the invention.

The pitch of the monolithic electroluminescent source may be smaller than or equal to 1 mm, and is preferably comprised between 500 and 20 microns (μm), inclusive of limits. The dimensions (L×l) of an electroluminescent element are preferably comprised between 10 and 500 microns (μm), inclusive of limits. The electroluminescent element may be square (L=l) or even rectangular. These dimensions are particularly suitable for an array of micro-lenses; for example, the micro-lenses have dimensions (L'×l') comprised between 10 and 4000 microns (μm), inclusive of limits FIG. 6 shows an example of a light-beam-projecting optical module 1, in particular for a motor vehicle. The module 1 comprises, from upstream to downstream, in the direction of propagation of the light rays along the optical axis 15, a monolithic electroluminescent source 2 comprising electroluminescent elements 8 able to emit light rays, a primary optical system 4 that transmits the light rays, and projecting means that are configured to project a light beam from the incident light rays transmitted by the primary optical system 4.

In the figures, the projecting means take the form of a single projecting lens 3. The projecting means could nevertheless be formed from the association of a plurality of lenses, of a plurality of reflectors, or even of a combination of one or more lenses and/or one or more reflectors.

The electroluminescent elements 8 are for example light-emitting diodes (LEDs) forming a network on the array 2 of electroluminescent elements, as shown in FIGS. 1 and 2.

The function of the primary optical system 4 is to transmit the light rays of the electroluminescent elements so that, combined by the projecting means, here taking the form of a projecting lens 3, the beam projected out of the module, for example onto the road, is uniform. To this end, the primary optical system 4 is equipped with a plurality of convergent optics, which are preferably convergent micro-lenses 5. Here, the entrance dioptric interfaces 5 are convex surfaces, i.e. they are curved toward the exterior, in the direction of the sources 8. These surfaces could however be planar, plano-convex or concave-convex. An entrance dioptric interface 5 is advantageously placed downstream of each light source 8, i.e. of each electroluminescent element. The entrance dioptric interfaces 5 preferably form virtual images 6 of the electroluminescent elements 8.

The virtual images 6 are formed upstream of the electroluminescent elements 8, and thus serve as new light sources for the projecting lens 3. The obtained virtual images 6 are enlarged and preferably substantially adjacent. In other words, they are not separated by a significant space. Furthermore, the contiguous virtual images may overlap slightly, this resulting in an overlap of their respective projections by the projecting means measured on a screen placed at 25 m from the device that will preferably be smaller than 1°. Thus, it is sought in the design of the primary optical system for the virtual images to be juxtaposed from a paraxial point of view, with a margin of tolerance in order to ensure robustness with respect to the precision with which the light sources are positioned and with respect to manufacturing defects in the surfaces of the dioptric micro-interfaces: the edges of each virtual image will be hazy, so as to obtain this slight overlap that will ensure the generated light beam has a good uniformity. The primary optical system 4 therefore allows virtual images 6 of the primary light sources 8 to be formed in order to obtain a beam with a uniform distribution, i.e. in order that the components of the light beam are correctly adjusted with respect to one another, without dark and/or bright (overly intense) strips therebetween that would decrease driver comfort. Thus, the streets or lanes present on the monolithic source are not visible in the light beam generated as output from the primary system 4 and the projecting lens 3, even if the streets/lanes have dimensions that are increased for the sake of decreasing the emitting areas of the source. Furthermore, the pixelization of the source 2 is preserved, i.e. the light beam generated is made up of as many pixels of light as there are electroluminescent elements in the source. If the source is a highly pixelized monolithic source, then the light beam preserves this high pixelization. As a result, the light beam generated may be used in driver-assist functions that require adaptive lighting, for example an anti-glare function.

In addition, the virtual images 6 are further from the projecting lens 3 than the actual array of light sources, this allowing the optical module to remain compact.

Figure 7:
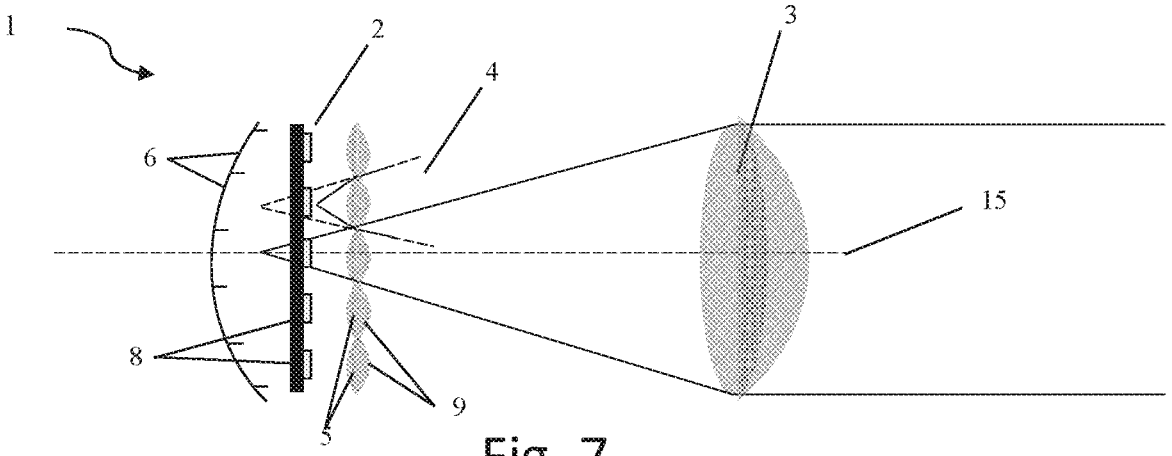
FIG. 7 schematically illustrates a perspective view of an example of a projecting module according to the invention.

The primary optical system 4 may advantageously be configured to form virtual images 6 on a curved surface, the dimensions of the virtual images 6 being larger than the dimensions of the primary light sources 8. This case is illustrated in FIG. 7. The curved surface allows the curvature of the field of the projecting system 3 to be compensated for.

Alternatively, the primary optical system 4 may be configured to form virtual images 6 on a plane, the dimensions of the virtual images 6 being larger than the dimensions of the primary light sources 8. This case is illustrated in FIG. 6.

As FIGS. 6 and 7 show, the enlargement of the size of the virtual images 6 allows the virtual images 6 to be juxtaposed so as to be adjacent to one another to form a continuous uniform distribution of light. To this end, the convex curvature of the convergent optics of the array and the material from which they are made are tailored to the dimensions of the source 2 of electroluminescent elements 8, as is the position of the primary optical system 4 with respect to the source 2, so that the virtual images 6 are correctly juxtaposed to form a continuous uniform distribution of light. Depending on the size 106 of the electroluminescent elements 8, on the size of the pitch 108 and/or on the size of the streets 104*a*, 104*b*, and depending on the sought-after enlargement, the distance between the monolithic electroluminescent source and the primary optical system 4 will for example be comprised between 0 mm and two times the pitch of the electroluminescent elements, inclusive of limits. These distances allow sufficient light to be collected.

The primary optical system 4 equipped with the entrance dioptric interfaces 5 furthermore comprises a single exit dioptric interface 9 for all the entrance dioptric interfaces 5. The exit dioptric interface 9 makes an optical correction to the beam transmitted to the projecting lens 3. This correction in particular serves to improve the optical efficacy of the device and to correct optical aberrations of the projecting optical system 3. To this end, the exit dioptric interface 9 has a substantially spherical dome shape. This shape deviates little the direction of the light rays of the beam coming from an electroluminescent element placed on the optical axis 15, and that pass through the exit dioptric interface 9. The exit dioptric interface may have an elongate shape, of cylindrical type, with a bifocal definition. Seen from in front, the exit dioptric interface 9 is wider than it is high. According to one preferred embodiment of this variant, the exit dioptric interface 9 has, in horizontal cross section—and therefore in the direction of its width—a large radius of curvature.

In the example of FIG. 6, the primary optical system 4 is made from a single material, i.e. integrally formed from the same material. In other words, the entrance dioptric interfaces 5 and the exit dioptric interface 9 form the entrance and exit faces of the same element, the primary optical system 4, which may be likened to a complex lens.

The example of FIG. 7 contains the same elements as the example of FIG. 6, except that the primary optical system 4 comprises one exit dioptric micro-interface 9 for each entrance dioptric micro-interface 5. The primary optical system 4 thus forms a set of bi-convex micro-lenses, each micro-lens being placed in front of one primary light source. The primary optical system 4 is an array of micro-lenses, for example the array shown in FIG. 4. The micro-lens however does not allow the transmitted overall beam to be corrected, unlike a primary optical system 4 equipped with a single exit dioptric interface 9. However, the correction of the overall beam may be achieved by the projecting means 3. The micro-lenses are however suitable for electroluminescent sources of high pixel density, in which the electroluminescent elements are of submillimetre size. They have the advantage of improving the uniformity of the virtual images and of deforming these images less. The micro-lenses have an angle of collection of the emitted light that must be maximal in order for them to collect all the light, even that emitted with a large emission angle. The angle of collection may preferably be comprised between 30° and 70°, inclusive of limits.

Figure 3:
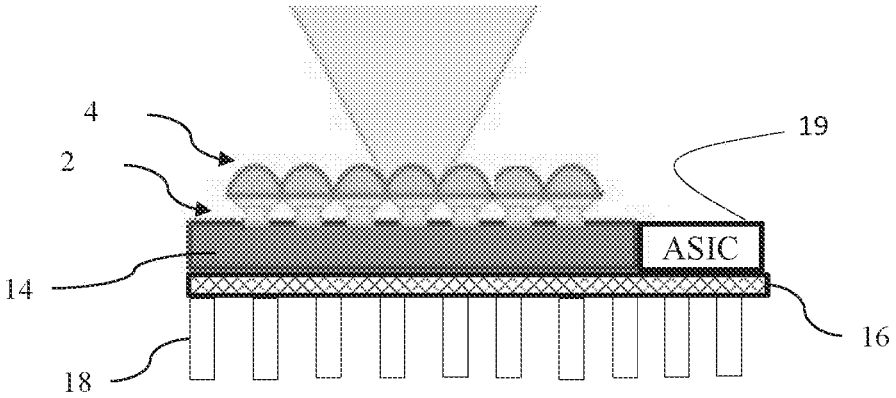
FIG. 3 schematically shows an example of a luminous module according to the invention.

FIG. 3 schematically shows one example of a luminous module for a motor vehicle. The luminous module 1 comprises a monolithic electroluminescent source 2 of high density on which a luminophore layer has been deposited, and a PCB 14 that holds the source 12 and a device 19 that controls the electroluminescent elements of the luminous monolithic source 2. Any other holder than a PCB may be envisioned. The luminous module furthermore comprises an array of micro-lenses 4. The luminous module may furthermore comprise at least one heat sink 18, which may be arranged directly or indirectly on the source 12. In this example, the heat sink 18 is arranged indirectly on the source since the PCB 14 and a thermal interface 16 are located between the heat sink 18 and the source 12. The heat sink allows the transfer of heat from the electroluminescent source, which heat the latter transmits to the PCB during use of a luminous module. The heat sink allows heat to be dissipated via an interaction with the holder 14 of the monolithic electroluminescent source, i.e. the heat sink receives the heat produced by the electroluminescent source. The heat sink 18 is thus in thermal communication with the PCB 14, which itself is in thermal communication with the source 12. The transmission may be achieved because the heat sink is in one example arranged directly against the PCB 14. This means that the heat sink makes physical (i.e. material) contact with the PCB. The heat sink 18 may however alternatively be arranged on the PCB via an intermediate element that improves the heat transfer. This intermediate element is also called a thermal interface 16. The intermediate element 16 may for example comprise a thermal grease or a phase-change material. The intermediate element may comprise copper and, for example, the thermal interface 16 may be a copper plate. Thus, the luminous module effectively dissipates heat. The effectiveness of the dissipation of the heat is correspondingly improved given that the module according to the invention may comprise electroluminescent elements of small size, as discussed above.

The invention also relates to an optical module comprising such a projecting device and projecting means, such as a projecting lens or a reflector, placed downstream of the primary optical system in the direction of projection of the light beam, the projecting means being able to project a light beam from virtual images serving as light sources for the projecting means, which are focused on said virtual images.

The latter feature of the invention is particularly interesting and advantageous. Specifically, the focus of the projecting means onto the virtual images, in particular onto the plane that contains said virtual images, makes the projecting optical module insensitive to manufacturing defects in the primary optical system: if the projecting means are focused onto the surface of the dioptric interfaces, it is this surface that is imaged and therefore all its manufacturing defects are made visible, this possibly generating uniformity defects or chromatic aberration in the projected light beam. In addition, this allows an array of electroluminescent elements with street/lanes of large dimension to be used in association with the primary optic, each electroluminescent element being individually imaged and the generated beam exhibiting no intervals between the various light beams from which the beam of the source is composed.

The invention also relates to a motor-vehicle light equipped with such an optical module.

The invention claimed is:

1. A luminous module for a motor vehicle, comprising:

a monolithic electroluminescent source comprising electroluminescent elements;

a primary optical system equipped with a plurality of convergent optics, each convergent optic being associated with and disposed downstream of a respective electroluminescent element and forming a virtual image of the respective electroluminescent element with which the convergent optic is associated, wherein the virtual images are formed upstream of the electroluminescent elements and are substantially adjacent to each other, the virtual images forming a light beam with uniform distribution.

2. The luminous module according to claim 1, wherein:

the electroluminescent elements of the monolithic source form an array of electroluminescent elements; and the convergent optics form an array of convergent microlenses.

3. The luminous module according to claim 2, wherein an optical axis of each convergent optic is aligned with a center of the respective electroluminescent element with which said convergent optic is associated.

4. The luminous module according to claim 2, wherein a distance between each convergent optic and the respective electroluminescent element with which said convergent optic is associated is smaller than or equal to an object focal length of said convergent optic.

5. The luminous module according to claim 2, wherein an angle of collection of the convergent optics is comprised between 30° and 70°, inclusive of limits.

6. The luminous module according to claim 2, wherein the plurality of convergent optics of the primary optical system covers the monolithic electroluminescent source.

7. The luminous module according to claim 2, wherein the plurality of convergent optics makes contact with the monolithic electroluminescent source.

8. The luminous module according to claim 1, wherein an optical axis of each convergent optic is aligned with a center of the respective electroluminescent element with which said convergent optic is associated.

9. The luminous module according to claim 1, wherein a distance between each convergent optic and the respective electroluminescent element with which said convergent optic is associated is smaller than or equal to an object focal length of said convergent optic.

10. The luminous module according to claim 1, wherein an angle of collection of the convergent optics is comprised between 30° and 70°, inclusive of limits.

11. The luminous module according to claim 1, wherein the plurality of convergent optics of the primary optical system covers the monolithic electroluminescent source.

12. The luminous module according to claim 1, wherein the plurality of convergent optics makes contact with the monolithic electroluminescent source.

13. The luminous module according to claim 1, wherein an intermediate element is arranged between the plurality of convergent optics and the monolithic electroluminescent source.

14. The luminous module according to claim 1, wherein a distance between a center of a first pixel and a center of a second pixel neighboring the first is comprised between 20 and 500 microns.

15. The luminous module according to claim 1, wherein dimensions of an electroluminescent element of the electroluminescent elements are comprised between 10 and 500 microns (μm).

16. The luminous module according to claim 1, wherein each convergent optic comprises at least one convex segment.

17. The luminous module according to claim 1, wherein the plurality of convergent optics is integrally formed from a same material.

18. The luminous module according to claim 1, wherein the electroluminescent elements of the monolithic electroluminescent source are light-emitting diodes.

19. A luminous device comprising:

a luminous module according to claim 1; and an optical projecting system forming an image of the virtual images produced by the primary optical system.

* * * * *